US008651656B2

(12) United States Patent
Roof et al.

(10) Patent No.: US 8,651,656 B2
(45) Date of Patent: Feb. 18, 2014

(54) SYSTEMS AND METHODS FOR FORMING RAISED MARKINGS ON SUBSTRATES FOR BRAILLE IDENTIFICATION AND SECURITY AND TO FACILITATE AUTOMATIC HANDLING OF THE SUBSTRATES

(75) Inventors: Bryan Roof, Newark, NY (US); Anthony S. Condello, Webster, NY (US); Grace T. Brewington, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 189 days.

(21) Appl. No.: 13/411,038

(22) Filed: Mar. 2, 2012

(65) Prior Publication Data

US 2013/0229452 A1 Sep. 5, 2013

(51) Int. Cl.
*B41J 3/407* (2006.01)

(52) U.S. Cl.
USPC ..... 347/106; 358/3.28; 283/74; 347/105; 347/107

(58) Field of Classification Search
CPC ..... B41J 3/32; B41J 5/07; G06K 15/02
USPC ..... 347/5, 105, 107; 358/2.1, 3.28; 283/74
See application file for complete search history.

(56) References Cited

U.S. PATENT DOCUMENTS 4,033,059 A * 7/1977 Hutton et al. ..... 283/91
4,457,656 A * 7/1984 Kosina et al. ..... 414/788.3
5,649,349 A * 7/1997 Greenway ..... 29/598
7,925,043 B2 4/2011 Kazmaier et al.
2010/0053287 A1 3/2010 Belelie et al.
2010/0055407 A1 3/2010 Belelie et al.
2010/0055415 A1 3/2010 Belelie et al.
2010/0055423 A1 3/2010 Chre'tien et al.
2010/0055484 A1 3/2010 Chretien et al.

OTHER PUBLICATIONS

Grace T. Brewington; U.S. Appl. No. 13/410,974, filed Mar. 2, 2012.

* cited by examiner

*Primary Examiner* — Julian Huffman
*Assistant Examiner* — Sharon A Polk
(74) *Attorney, Agent, or Firm* — Ronald E. Prass, Jr.; Prass LLP

(57) ABSTRACT

Haptic or tactile features, which are generally not visually perceptible or reproducible, are applied at varying positions on a substrate according to a predetermined scheme. A plurality of raised image areas are specified for a group of substrates and raised marks are printed in only one raised image area for each substrate in a manner that is evenly distributed between the raised image areas for the group of substrates. The substrates will present a relatively uniform stack avoiding localized large pile heights when the substrates are stacked. A clear marking material is used to print the raised marks so as not to obscure underlying data printed on the substrate. The clear marking material may include a monomer that may become cross-linked in an exposure process to resist deinking of the substrate. The clear marking material may be mixed with a phosphorescing or fluorescing material as an additional security measure.

20 Claims, 3 Drawing Sheets

SYSTEMS AND METHODS FOR FORMING RAISED MARKINGS ON SUBSTRATES FOR BRAILLE IDENTIFICATION AND SECURITY AND TO FACILITATE AUTOMATIC HANDLING OF THE SUBSTRATES

This application is related to U.S. patent application Ser. No. 13/410,974 entitled "Systems and Methods For Printing Hybrid Raised Markings on Documents to Enhance Security," which is co-owned with this application, and the disclosure of which is hereby incorporated by reference herein in its entirety.

BACKGROUND

1. Field of Disclosed Subject Matter

This disclosure relates to systems and methods for applying raised markings on documents, particularly paper currency, to provide enhanced security for the documents and to provide recognition of the documents for the visually impaired, without adversely impacting automated document handling of the documents.

2. Related Art

The U.S. Government, like other governments world-wide, prints "paper" currency for use in domestic and international trade and transactions. Paper currency, like many other forms of printed documents that have an intrinsic monetary value ("documents of value"), is historically a target of forgers or counterfeiters. The forgers or counterfeiters painstakingly produce or reproduce copies of the documents of value and then attempt to pass the forgeries off as original and genuine documents of value.

The existence and use of counterfeit currency can have economically devastating effects. Because of this, governments expend significant resources to make forgery and counterfeiting of currency incredibly difficult. Historically, efforts to counter forgery or counterfeiting of currency and other documents of value often involved the inclusion of increasingly sophisticated fine details in the printing of the currency or other documents. These fine details were designed in a manner that they were not easily reproducible according to traditional document production or reproduction printing methods. An objective of anti-forgery and anti-counterfeiting methods and techniques was to include printed details in the produced documents of value that were easily recognizable such that the absence of these printed details could be readily detected by simple visual inspection of the documents of value by virtually any observer on careful inspection of the documents of value.

The widespread availability of all manner of increasingly sophisticated image forming devices, such as printers and copiers, which are capable of producing and reproducing extremely high quality color copies of original authentic documents, has rendered obsolete many of the more simplistic, traditional anti-forgery or anti-counterfeiting methods and techniques. Digital printers, copiers and scanners, coupled with sophisticated image editing software, make it possible to produce unauthorized high-quality copies of legitimate documents of value, including currency, that are increasingly difficult to distinguish from genuine original documents. In other words, developments made in computer and photocopying technologies have made it possible for individuals with very little training, and comparatively little effort, to easily copy documents of value, including currency. The quality of these unauthorized imitations, in many instances, makes them all but impossible to distinguish from genuine documents, when the only features that may be used to distinguish the copies from the originals are the content of the printed image.

Government agencies and corporate entities responsible for the generation and control of all manner of documents of value, including currency, combat increasingly sophisticated counterfeiting techniques by employing equally increasingly sophisticated marking methods that remain directed at the objective of including details in the printed documents the absence of which may be easily detected. Among the techniques that have been implemented are the use of increasingly sophisticated graphic designs, holograms, multiple and unique color schemes and shading, watermarking strips embedded in document substrates, other embedded identification devices, micro-printing techniques and inks that appear to the visual inspector to change color depending on an angle at which ambient light is reflected off the surface of the document.

This game of cat and mouse continues. Counterfeiters and forgers continue to seek new and unique ways of stymieing all efforts to stop them. In an effort to avoid the inclusion of embedded watermarks, for example, in the substrates on which U.S. currency is printed, counterfeiters and forgers have been known to apply a deinking process, for example, to five dollar bills and to reprint them with the markings of hundred dollar bills in order to attempt to pass the counterfeits off as genuine hundred dollar bills. A quick visual inspection may reveal the embedded watermarking strip without the inspector recognizing that the displayed the denomination on the face of the currency and the information presented on the embedded watermarking strip do not match.

In ongoing efforts to stifle forging and counterfeiting, some countries have turned to the use of, for example, advanced printing and security techniques in the form of polymer banknotes. Introduced first in Australia in the late 1980s, it is estimated that more than 25 countries worldwide employ such polymer banknotes. Canada, in 2011, began issuing polymer banknotes that include detailed anti-forgery and anti-counterfeiting features. Among these are certain raised features that, in addition to providing a heightened level of security for the documents, also provide distinguishing "haptic" or "tactilely discernible" characteristics on the surface of the banknotes by which visually impaired individuals can distinguish, for example, different denominations of the banknotes by touch.

While currency represents perhaps the most commonly-understood and commonly used form of value documents that is the target of forgers and counterfeiters based on its widespread circulation and every day use, other examples of documents of value include lottery tickets, travelers checks, and commercial tickets for transportation and leisure activities. A non-exhaustive list of these latter categories of tickets includes airline tickets, cruise tickets, sporting event tickets, concert tickets and tickets for admission to large theme parks. Commercial enterprises that deal with tickets as forms of documents of value seek to apply techniques similar to those employed by governments in protecting their currency to avoid unauthorized copying of their documents of value. Many of these commercial enterprises choose to encode authenticating information as individual barcodes, or glyph elements, for example, either of which may be machine scanned and authenticated at a point of entry or point of embarkation, as appropriate. These enterprises also use authenticating information embedded in a design on the face of the document that is printed in such a manner as to allow the design to catch light differently when the document is tilted, sometimes resulting in a different image being discernible altogether.

The objective of anti-forgery and anti-counterfeiting techniques and methods, regardless of the form they take, remains to provide a simple manner by which to verify the authenticity of a document of value with inclusion of features that may or may not be visually discernible, or are otherwise very difficult to reproduce, in order that an unauthorized reproduction of a document of value can be distinguished from a genuine document.

SUMMARY OF THE DISCLOSED EMBODIMENTS

Currency and other documents that are augmented with haptic or tactile features provide significant advantages in security of the documents, and in document discrimination to, for example, the visually impaired, that are not realized in documents that do not include such haptic or tactile features. See, e.g., co-owned U.S. Pat. No. 7,925,043 B2, and co-owned U.S. Patent Application Publication Nos. 20100053287, 20100055407, 20100055415, 20100055423 and 20100055484.

Automated handling, including counting, sorting, stacking and dispensing, of documents of value, including currency from, for example, automatic teller machines (ATMs) and other self-service kiosk dispensers has become prolific. The banking industry, among other corporate entities, relies on all manner of automated dispensing of paper currency to increase productivity, and to provide a level of customer convenience that has come to be expected. Such devices, which were originally developed simply to dispense cash, now include options for carrying out myriad other functions related to individual banking transactions. Moreover, self-service kiosks are available to facilitate many other transactions in commerce that do not relate to banking Additional transactions undertaken by self-service kiosks with which a particular user may interact include, for example, on-demand printing and dispensing of documents of value, such as lottery tickets, transportation tickets, entertainment tickets, travelers checks, gift certificates or other documents to which a specific value is attached, which may be printed on preliminarily-formatted substrates and dispensed to a customer from the self-service kiosk.

In order to facilitate their operation, ATMs are loaded with stacks of paper currency. Other self-service kiosks are often loaded with stacks of specifically pre-printed forms, the details of which may be filled in according to the customer's transaction at the self-service kiosk. The inclusion of haptic or tactile features on currency and other substrates, despite the significant advantages that such features present, results in an attendant difficulty when the currency and other substrates are stacked in ATMs and self-service kiosks.

Typical thicknesses for paper stock are in a range of approximately 70 to 180 μm. An estimated thickness of U.S. paper currency stock is approximately 110 μm. Typical card stock used as a substrate for certain printed and printable documents has a thickness in a range of approximately 250 to 300 μm.

While haptic or tactile features may be limitedly perceptible in thicknesses of under 50 μm when deposited on the surface of a substrate by a steam that is intended to simply allow for the detection of their presence, typical heights for discernible or "tactilely readable" features are in a range of approximately 100 to 500 μm. The national standard for Braille publications in the United States, for example, is published as Specification 800, "Braille Books and Pamphlets" by the National Library Service. Under the heading "Size and Spacing," Specification 800 provides that "[t]he nominal height of braille dots shall be 0.019 inches," or approximately 480 μm.

Typical in the prior art is that haptic or tactile features will be placed in a specific location on one or the other faces of the currency or other document substrate. This consistent positioning of the haptic or tactile features facilitates ease of printing of the currency or other documents of value. Based on the above-specified thickness ranges, however, the inclusion of haptic or tactile features on documents of value, including currency, will cause a localized increase in thickness of the documents in the particular region of the document to which the haptic or tactile features are applied. Local thickening of the basic document can be on the order of more than 300%. Such a localized increase in thickness at a same location on each bill or substrate is anticipated to result in stacks of currency, documents of value or other substrates becoming unusable in currently-deployed ATMs and other self-service kiosks.

It would be advantageous in order to facilitate automated handling of currency and other document substrates that are augmented with haptic or tactile features to provide systems and methods by which the haptic or tactile features are distributed at different predetermined positions on a face of the currency and other substrates to which the haptic or tactile features are applied.

Exemplary embodiments may provide a mechanism whereby haptic or tactile features, which are generally not visually perceptible or reproducible, are applied at varying positions on the face of a substrate according to a predetermined scheme when the haptic or tactile features are printed on sequential substrates.

Exemplary embodiments may provide a mechanism whereby raised marks are applied to currency or other substrates with radiation curable inks such as, for example, a clear ultraviolet (UV) curable gel ink, epoxies or other resin materials, such that a series of raised marks such as, for example, bumps, are created on the surface of the currency or other substrate in differing predetermined locations for sequential substrates when the haptic or tactile features are printed on sequential substrates.

Exemplary embodiments may provide visually impaired individuals with a mechanism whereby those individuals are more readily able to determine a denomination and/or a country of origin of paper currency by tactilely sensing haptic features added to a face of the currency in a manner that (1) is tactilely readable by the visually impaired individual, and (2) does not adversely impact automated handling of the currency. By building up drops of clear UV gel ink, epoxies or other resin materials, for example, bumps can be created and arranged on currency that would inform visually impaired individuals of the denomination and/or country of origin of the currency based on the applied pattern.

Exemplary embodiments may provide improved resistance to deinking The use of certain compositions of inks to include, for example, monomers in the inks that may become cross linked during an exposure process, will aid in a resistance of the printed currency or other substrate to deinking Exemplary embodiments may provide additional security in the form of adding to the clear UV gel ink, epoxy or other resin material, at least one of phosphorescing or fluorescing materials that would render the haptic or tactilely perceptible features readable in other than ambient lighting conditions. These materials, which may be, for example, in the form of dyes or particles mixed with the clear UV gel ink, epoxy or other resin material, will allow for scanning methods using alternative light sources as a further check of currency or document legitimacy. It remains true that simply adding haptic or tactilely perceptible features to the surface of the document will increase document security in the manner described in the above-enumerated related documents. According to a user's desires or preferences, however, the further addition of, for example, such phosphorescing or fluorescing materials may further aid in easily distinguishing counterfeit documents of value from genuine documents of value, without requiring additional complicated automated document reading mechanisms.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for applying radiation curable raised ink markings on documents, particularly paper currency, to provide enhanced security for the documents and to provide recognition of the documents for the visually impaired, without adversely impacting automated document handling of the documents, will be described, in detail, with reference to the following drawings, in which.

DETAILED DESCRIPTION OF THE DISCLOSED EMBODIMENTS

Figure 1A:
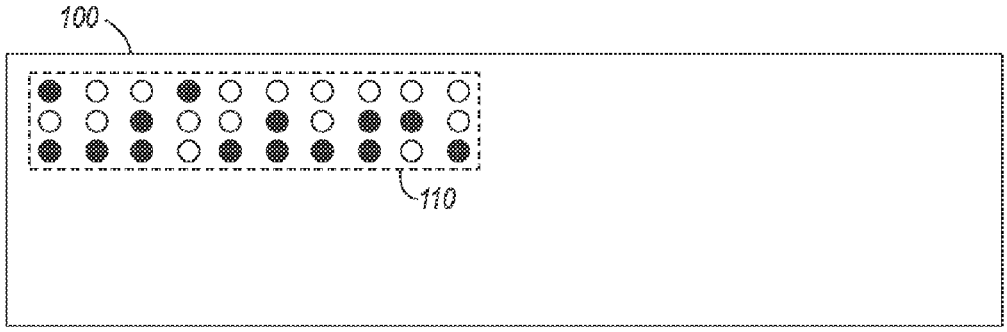
FIGS. 1A-1D illustrate an exemplary overview of a marking scheme for including raised haptic or tactile markings on the face of currency or other substrates on which documents of value may be printed according to this disclosure.

The systems and methods for applying marking materials, including radiation curable inks, in a manner that produces raised markings on documents, particularly paper currency, to provide enhanced security for the documents and to provide recognition of the documents for the visually impaired, without adversely impacting automated document handling of the documents according to this disclosure will generally refer to this specific combination of utilities or functions for those systems and methods. Exemplary embodiments described and depicted in this disclosure should not be interpreted as being specifically limited to any particular configuration, or directed to any particular intended use.

Specific reference to, for example, an image forming device throughout this disclosure should not be considered as being limited to any particular type of image forming device including, for example, any of a printer, a copier or a multifunction device. The systems and methods according to this disclosure will be described as being particularly adaptable to use in printing and/or copying devices that employ inkjets to jet marking materials including UV curable gel inks onto a substrate, but the systems and methods should not be construed as being necessarily limited to only these types of devices or jetted inks Rather, any deposition device that may be employed to dispose, on the surface of the substrate, a marking material that may be built up to produce haptic or tactilely perceptible features on the surface of the substrate is contemplated.

The systems and methods according this disclosure may use known methods such as, for example, ink jet printing to deposit a radiation curable gel ink, including a UV curable gel ink, on a substrate. Examples of these known methods are described, for example, in U.S. Patent Application Publication No. 20100055423, which is commonly assigned, and the disclosure of which is incorporated herein by reference in its entirety. The '423 publication discloses that, with a clear gel ink having a 7.5% gel content, the formed printed structures on the surface of the disclosed substrates may be up to 500 μm tall. The disclosed ink jetting method may employ a common inkjet printing device with, for example, multiple scanning heads and an LED curing bar attached, but there are many potential architectures for the device.

The systems and methods according to this disclosure may be particularly distinguished as including a mechanism whereby an area on the face of subsequent substrates where raised features are deposited is moved according to a predetermined scheme to avoid large pile heights that may occur when bills or other substrates are stacked if the haptic or tactile features are deposited always at the same position on the substrate.

The systems and methods according to this disclosure may advantageously employ clear UV gel inks, epoxies or other resin materials to make raised Braille dots to mark currency with an indication of an issuing authority and a denomination. The use of clear UV gel inks supports the build-up of structures to as tall as 500 μm from the surface of the substrate and preferably does not obscure underlying features on the surface of currency once printed, or on the surface of some preprinted form of tickets to which only specific information regarding, for example, the actual seat number and/or conveyance number will be over-printed in an area that does not include the raised markings The clear UV gel inks may be composed of monomers that are cross-linked in the exposure process to resist deinking The clear UV gel inks may be mixed with at least one of a phosphorescing or fluorescing material in the ink as an additional security feature.

FIGS. 1A-1D illustrate an exemplary overview of a marking scheme for including raised haptic or tactile markings on the face of currency or other substrates on which documents of value may be printed according to this disclosure. As shown in FIGS. 1A-D, document substrates 100, 120, 140, 160 may have printed on them raised marks in marking areas 110, 130, 150, 170, respectively. In a preferred embodiment, the plurality of marking areas 110, 130, 150, 170 will generally be set out on the face of the document substrate in a non-overlapping manner with the raised markings being printed in only one of the plurality of marking areas for each substrate.

It is recognized that for currency particularly, it may be difficult, or be considered too time-consuming, to carefully stack the individual bills to ensure that consecutively stacked bills do not have the raised marks in the same one of the plurality of marking areas. Although such careful distinction may be preferable, it is most likely that printing on the individual bills in a plurality of non-overlapping areas in the manner disclosed will be sufficient to facilitate automatic handling of randomly stacked bills simply based on the marking areas being separately dispersed on relative percentages of individual bills according to the number of marking areas that may be employed for a particular substrate.

Figure 1B:
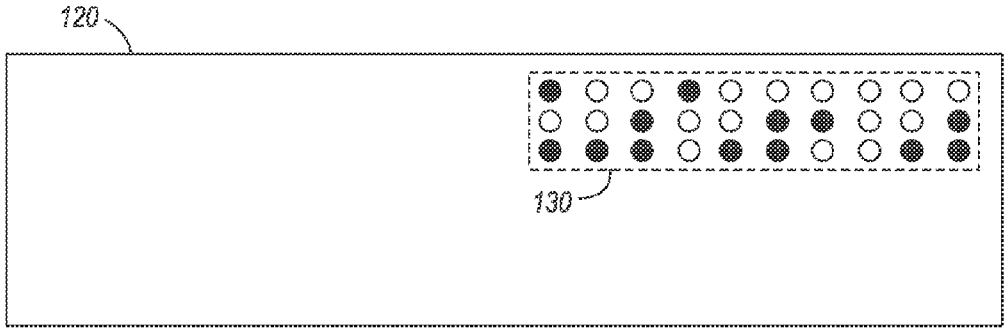
Figure 1C:
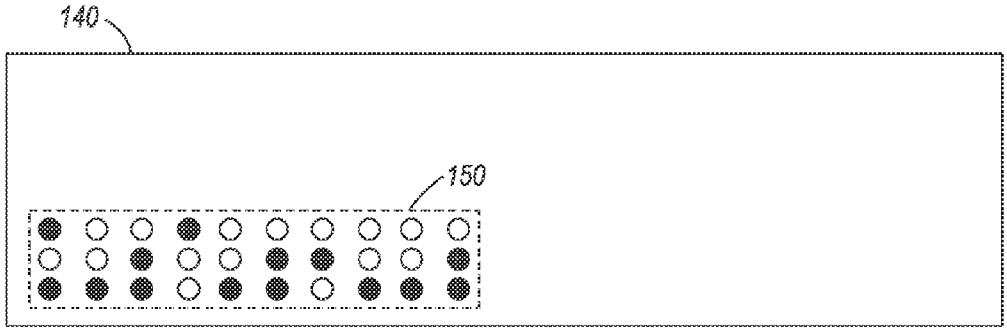
Figure 1D:
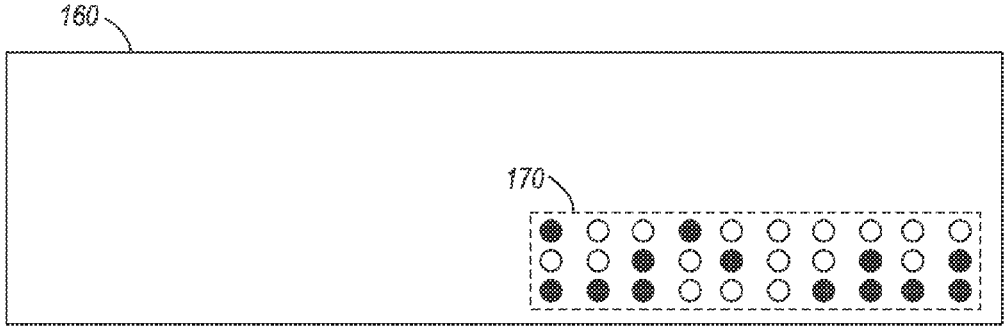

Individual sets of marks could be set forth in any manner that distinguishes the individual substrates to facilitate identification for security purposes, and discrimination by visually impaired individuals. In the examples shown in FIGS. 1A-1D, common Braille lettering is used to identify an issuing authority and denomination of the respective "bill." FIG. 1A depicts exemplary Braille lettering for a United States five dollar bill as "U.S.005." FIG. 1B depicts exemplary Braille lettering for a United States ten dollar bill as "U.S.010." FIG. 1C depicts exemplary Braille lettering for a United States fifty dollar bill as "U.S.050." FIG. 1D depicts exemplary Braille lettering for a United States one hundred dollar bill as "U.S.100." This scheme of both positioning and content is by way of example only. Any common, and otherwise commonly understood, identification scheme, as well as any non-overlapping positioning for a plurality of marking areas of any specified number and size that can be accommodated separately, and preferably in a non-overlapping manner, on a particular document substrate, may be adopted.

Figure 2:
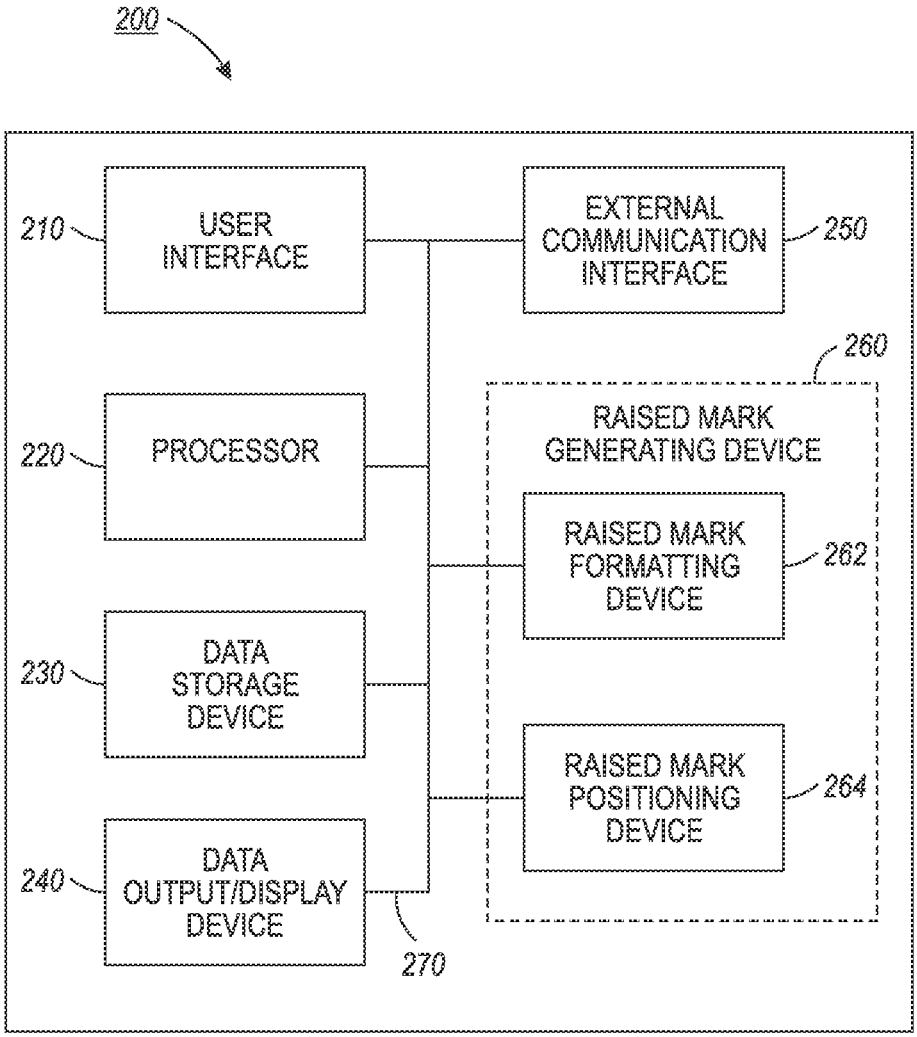
FIG. 2 illustrates a block diagram of an exemplary system for controlling an image forming device that applies a marking material in a manner that produces raised markings on documents to vary the positioning of the raised markings printed on sequential substrates according to this disclosure.

FIG. 2 illustrates a block diagram of an exemplary system 200 for controlling an image forming device that applies a marking material in a manner that produces raised markings on documents to vary the positioning of the raised markings printed on sequential substrates according to this disclosure. In the discussion that follows, it should be recognized that known methods exist for depositing marking material on a particular portion of a substrate either through manipulation of a portion of an image forming device that actually deposits the marking material on the substrate, or by modifying positioning of the substrate with reference to the portion of the image forming device that actually deposits the marking material on the substrate. Portions of the exemplary system 200 shown in FIG. 2 may be housed in, or attached to, a particular image forming device. The particular image forming device may be a combined image forming device that also prints detailed images on the substrate, or may be a separate image forming device either downstream of, or not in any way positionally associated with, the image forming device that prints detailed images on the substrate.

The exemplary system 200 may include a user interface 210 by which a user may communicate with the exemplary system 200. The user interface 210 may be housed and used in conjunction with an associated data output/display device 240 as a stand-alone user interface/display device combination associated only with the operation functioning of the system 200. Otherwise, the user interface 210, in association with the data output/display device 240, may be incorporated as a portion or function within a graphical user interface (GUI) of the image forming device. Finally, the user interface 210, in association with the data output/display device 240, may be incorporated in a separate user workstation that communicates with the image forming device. Regardless of its positioning, the user interface 210 may be configured as one or more conventional mechanisms common to computing devices such as, for example, a user's workstation, or otherwise common to image forming devices, that permit the user to input information to the exemplary system 200. The user interface 210 may include, for example, a conventional keyboard and mouse, a touchscreen with "soft" buttons or with various components for use with a compatible stylus, a microphone by which a user may provide oral commands to the exemplary system 200 to be "translated" by a voice recognition program, or other like device by which a user may communicate specific operating instructions to the exemplary system 200.

The user interface 210 may be employed by the user to provide instructions to the system 200 to direct operations of the system 200 and to carry out the function of depositing a specific marking material to provide raised marks on the face of the substrate that may or may not be visually perceptible, but that provide enhanced security, and the capacity for a visually impaired individual to identify the substrate. For its part, the data output/display device 240 may comprise any conventional means by which to display relevant data regarding the functioning of the exemplary system 200, and may provide the user, in conjunction with the user interface 210, a means to interactively communicate with, and control, the specific marking functions undertaken by the exemplary system 200.

The exemplary system 200 may include one or more local processors 220 for individually operating the exemplary system 200 and carrying out the portions of the image forming function for forming raised images on substrates by the exemplary system 200. As with the user interface 210, the processor(s) 220 of the exemplary system 200 may be resident in one or more image forming devices or in a user's workstation that communicates with the one or more image forming devices. Processor(s) 220 may include at least one conventional processor or microprocessor that may be provided to interpret and execute instructions in cooperation with other system components for depositing marking materials such as, for example gel inks, epoxies or other resin materials on the surface of substrates to form raised marks.

The exemplary system 200 may include one or more data storage devices 230, which may be located in any of the specific locations discussed above. Such data storage device (s) 230 may be used to store relevant data, and/or such operating programs as may be used by the exemplary system 200, and specifically the processor(s) 220 to carry into effect the exemplary marking schemes according to this disclosure. At least one data storage device 230 may be designated to act as a specific repository preformatted schemes for associating a plurality of marking areas for raised marks with specific types of substrates, or specifically-identified sizes of substrates. Data storage device(s) 230 may include a random access memory (RAM) or another type of dynamic storage device that is capable of storing collected information, and separately of storing instructions for execution of system operations by, for example, processor(s) 220. Data storage device (s) 230 may also include a read-only memory (ROM), which may include a conventional ROM device or another type of static storage device that stores static information and instructions for processor(s) 220.

The exemplary system 200 may include one or more external data communication interfaces 250. The external data communication interface(s) 250 may be provided to facilitate communication with one or more user workstations and/or one or more image forming devices, when the exemplary system 200 is separately housed from either or both of the one or more user workstations and the one or more image forming devices. The external data communication interfaces 250 may be provided to facilitate communication to or from the one or more image forming devices specifically carrying out the printing of raised marks on the surface of the substrate to relay instructions from other components of the exemplary system 200 as to the positioning and formatting of the raised marks on the substrate.

The exemplary system 200 may include a raised mark generating device 260 that may specifically include individual components such as, for example, a raised mark formatting device 262, and a raised mark positioning device 264. The raised mark generating device 260 may operate in conjunction with the processor(s) 220 to control specific deposition of a marking material in the image forming device to provide separate imaging on the substrate that may not be specifically associated with any underlying image printed by the image forming device on the substrate. As indicated above, the image forming device with which the exemplary system 200 is associated may be the same image forming device as, or a different image forming device from, the image forming device that prints an underlying print image on the substrate.

The raised mark formatting device 262 of the raised mark generating device 260 may be provided to specifically format the raised features to be placed on a surface of the substrate according to a predetermined scheme. This predetermined scheme, as indicated above, may be separate and distinct from the image forming scheme carried out by an image forming device to print an underlying image on the substrate. The raised mark formatting device 262 may, for example, identify the substrate, or identify the images preprinted on the substrate, and associate a specifically-formatted set of raised marks to be printed on the substrate, including over an underlying image that is already printed on the substrate. Alternatively, the raised mark formatting device 262 may direct that a set of raised marks be printed on the substrate that may have nothing to do with other information or images printed on the substrate.

The raised mark positioning device 264 of the raised mark generating device 260 may be provided to identify for a particular substrate, or a particular size of substrate, a plurality of separate, distinct and non-overlapping raised mark forming areas for the particular substrate. The raised mark positioning device 264 may direct, according to a predetermined scheme, a total number of substrates on which raised marks are to be printed, a manual input from the user, or otherwise, a distribution of formatted raised mark images to be printed in each of the plurality of separate, distinct and non-overlapping raised mark forming areas. The raised mark positioning device 264 may, for example, cycle printing of raised marks through each of the plurality of raised mark forming areas by directing that, on each sequential substrate, the raised marks be printed in a different one of the plurality of raised mark forming areas. Alternatively, the raised mark positioning device 264 may determine, through measurement, user input or otherwise, a total number of substrates to be printed with raised marks. The raised mark positioning device 264 may then, on its own or in communication with the processor(s) 220, for example, divide the total number of substrates to be printed with raised marks by the number of separate raised mark forming areas to determine when the printing of raised marks should be cycled from one of the plurality of raised mark forming areas to another of the plurality of raised mark forming areas. These exemplary schemes are presented for clarity and ease of understanding and should not be considered as limiting to the disclosed subject matter in any way.

All of the various components of the exemplary system 200, as depicted in FIG. 2, may be connected by one or more data/control busses 270. These data/control busses 270 may provide wired or wireless communication between the various components of the exemplary system 200 regardless of whether those components are housed within the user workstation, an image forming device, or are housed independently.

It should be appreciated that, although depicted in FIG. 2 as what appears to be an integral unit, as is outlined in detail above, the various disclosed elements of the exemplary system 200 may be arranged in any combination of sub-systems as individual components or combinations of components, integral to a single unit, or as separate components housed in one or more user workstations and/or one or more image forming devices, with which the exemplary system 200 is associated. Therefore, no specific configuration for the exemplary system 200 is to be implied by the depiction in FIG. 2.

Figure 3:
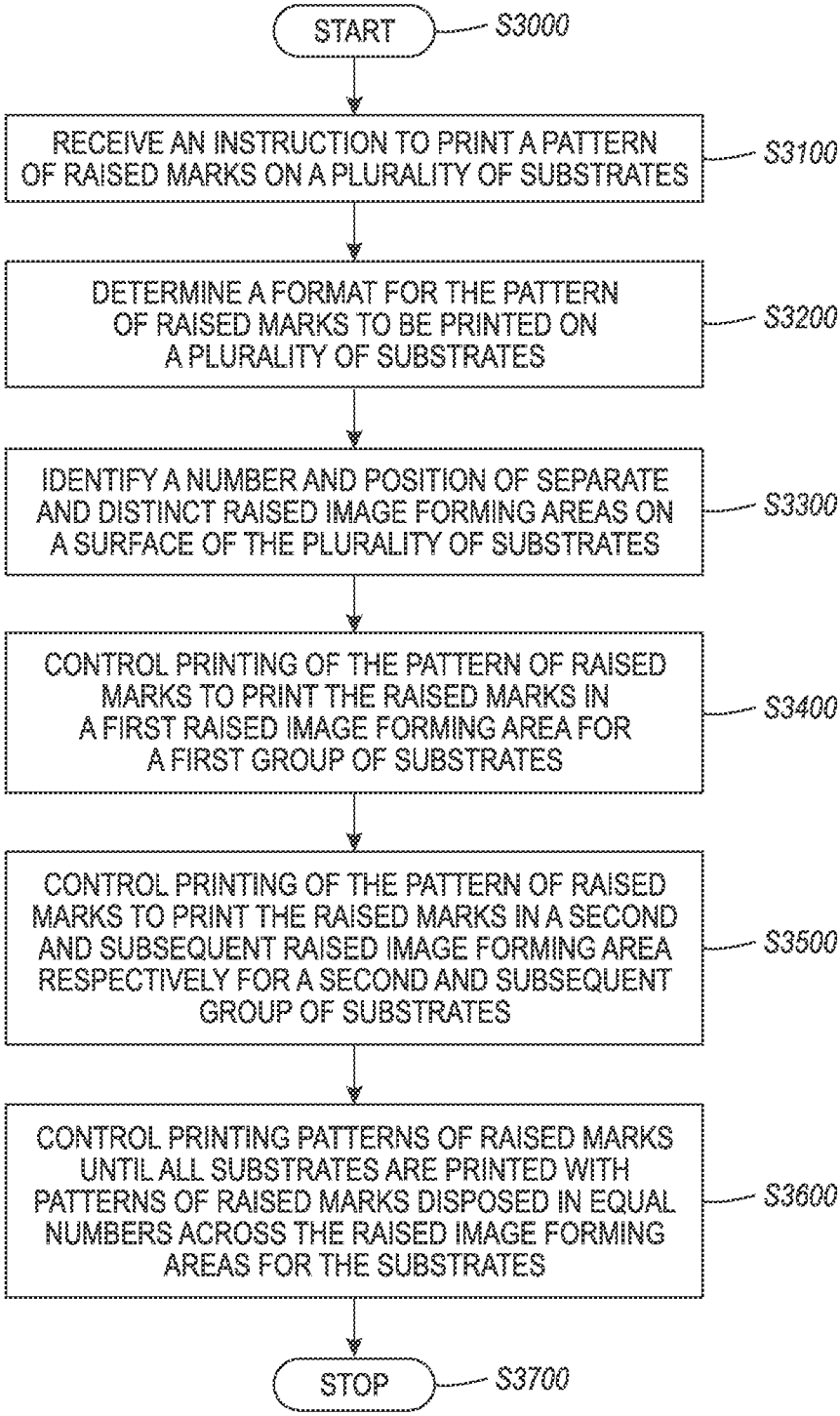
FIG. 3 illustrates a flowchart of an exemplary method for controlling an image forming device that applies a marking material in a manner that produces raised markings on documents to vary the positioning of the raised markings printed on sequential substrates according to this disclosure.

The disclosed embodiments may include a method for controlling an image forming device that applies a marking material in a manner that produces raised markings on documents to vary the positioning of the raised markings printed on sequential substrates. FIG. 3 illustrates a flowchart of such an exemplary method. As shown in FIG. 3, operation of the method commences at Step S3000 and proceeds to Step S3100.

In Step S3100, an instruction may be received to print raised marks on a surface of a plurality of substrates. These raised marks may be printed using common marking materials. The raised marks may be printed using inkjet printing methods that include depositing radiation curable gel inks, including a clear UV curable gel ink, epoxies or other resin materials on the surface of the substrate in a manner that does not obscure images already printed on the substrate. The clear UV curable gel ink may comprise monomers that are cross-linked in the exposure process to resist deinking of finished substrates to which the raised marks are applied. The clear UV curable gel ink may also be mixed with at least one phosphorescing or fluorescing material, which may be in the form of a dye or particles, that may provide additional security discrimination when a finished substrate is subjected to non-ambient lighting conditions. Operation of the method proceeds to Step S3200.

In Step S3200, a pattern for the raised marks may be determined. The determination of the formatting of the pattern for the raised marks may be according to a manual user input, or otherwise may be specifically associated with specifications of the substrate, or the images printed thereon, according to a predetermined scheme. For example, if the raised marks are to be printed on currency for security purposes, or for discrimination of the denominations or issuing authorities of the currency by visually impaired individuals, the pattern of the raised marks may be predetermined to signify an issuing authority and denomination of the currency, according to some commonly accepted or commonly understood marking scheme such as, for example, a Braille marking scheme. Operation of the method proceeds to Step S3300.

In Step S3300, a number, orientation and relative positioning of separate and distinct, preferably non-overlapping, raised image forming areas may be identified for a particular substrate. As with the format of the pattern for the raised marks, the identification of the number and the relative positioning of the separate and distinct raised image forming areas may be based on a manual input from the user, or otherwise may be specifically predetermined based on characteristics of the substrate to include, for example, a specific size and shape of the substrate and/or a content of any image preprinted on the substrate. Preferably, a plurality of identified raised image forming areas will be generally evenly sized, shaped and dispersed over a surface of the substrate. An objective of the marking scheme according to this disclosure may be to provide that relative percentages of finished substrates will have raised marks evenly disposed on a separate portion of their surfaces with a distribution that provides that a stack of the finished substrates will not present any localized relatively larger pile heights when stacked. Operation of the method proceeds to Step S3400.

In Step S3400, printing of raised marks is controlled to print the raised marks, as formatted, in a first of the plurality of raised image forming areas. The printing of the raised marks may be according to, for example, known inkjet, or other, printing methods. The printing of the raised marks may occur in a combined image forming device that first prints and finishes an underlying image on the substrate and then overprints the raised marks in the first of the plurality of raised image forming areas. Alternatively, the printing of the raised marks may occur in a separate image forming device in which, for example, pre-printed substrates such as, for example, currency, may have finished images printed thereon. The pre-printed substrates may then be input to the raised mark image forming device for further processing. The printing of the raised marks on the substrate will preferably result in raised marks that are tactilely perceptible or readable, and preferably in a range of 100 to 500 μm. Operation of the method proceeds to Step S3500.

In Step S3500, printing of raised marks is controlled to print the raised marks, as formatted, in a second or subsequent of the plurality of raised image forming areas on a second or subsequent substrate. The movement of the printing of the raised marks from the first of the plurality of raised image forming areas to the second or subsequent of the plurality of raised image forming areas may involve, for example, directing jetting of the ink from separate nozzles in an inkjet print head. Alternatively, the movement of the printing of the raised marks from the first of the plurality of raised image forming areas to the second or subsequent of the plurality of raised image forming areas may involve physically offsetting the second or subsequent substrates in a manner that modifies the relative positioning between the second or subsequent substrates and the inkjet print head. The movement of the printing of the raised marks may occur on each successively-printed substrate. Otherwise, a total number of substrates for a particular print job may be determined. Processing may occur to, for example, divide the total number of substrates by the number of separate and distinct raised image forming areas to be formed on the substrates to determine a number of substrates that will have raised marks printed in each of the identified raised image forming areas. In such instance, the movement of the raised marks may occur after printing occurs in one of the plurality of raised image forming areas for the determined number of substrates. The movement of the printing of the raised marks may otherwise occur according to some predetermined distribution scheme to generally evenly distribute the printing of raised marks among the plurality of raised image forming areas for all of the substrates in a particular print job. Operation of the method proceeds to Step S3600.

In Step S3600, printing of raised marks on the substrates will continue in the manner described above, with raised marks being relatively evenly distributed between the plurality of raised image forming areas on separate substrates, until raised images are printed on all of the substrates. Operation of the method proceeds to Step S3700, were operation the method ceases.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable processing means by which to carry into effect the disclosed raised image marking schemes for familiarity and ease of understanding. Although not required, elements of the disclosed exemplary embodiments may be provided, at least in part, in a form of hardware circuits, firmware, or software computer-executable instructions to carry out the specific functions described. These may include individual program modules executed by one or more processors. Generally, program modules include routine programs, objects, components, data structures, and the like that perform particular tasks, or implement particular data types, in support of the overall objective of the systems and methods according to this disclosure.

Those skilled in the art will appreciate that other embodiments of the disclosed subject matter may be practiced with many types of image forming devices, or combinations of image forming devices in many different configurations. Embodiments according to this disclosure may be practiced, for example, in network environments, where processing and control tasks may be performed according to instructions input at a user's workstation and/or according to predetermined schemes that may be stored in data storage devices and executed by particular image forming devices or combinations of image forming devices.

As indicated above, embodiments within the scope of this disclosure may also include computer-readable media having stored computer-executable instructions or data structures that can be accessed, read and executed by one or more processors, for example, in one or more image forming devices. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures. When information is transferred or provided over a network or via another communications connection, whether wired, wireless, or in some combination of the two, the receiving processor properly views the connection as a computer-readable medium. Combinations of the above should also be included within the scope of the computer-readable media for the purposes of this disclosure.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps. The exemplary depicted steps may be executed in any reasonable order to effect the objectives of the disclosed embodiments. No particular order to the disclosed steps of the method is necessarily implied by the depiction in FIG. 3, and the accompanying description, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure. For example, the principles of the disclosure may be applied to each individual image forming device of a plurality of image forming devices, widely deployed and connected to any number of communications interfaces. In such instances, each image forming device may include some portion of the disclosed system and execute some portion of the disclosed method.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A method for controlling printing raised marks on a plurality of substrates, comprising:

identifying, by a processor, a plurality of raised image areas on a surface of a substrate;

printing raised marks in one of the plurality of raised image areas on each substrate, the printing of the raised marks comprising depositing a marking material on the substrate by an image forming device;

cycling the printing of the raised marks among the plurality of raised image areas for a plurality of substrates; and outputting a stack of finished substrates, the raised marks being relatively evenly distributed among the plurality of raised image areas for the plurality of substrates.

2. The method of claim 1, the cycling of the printing of the raised marks comprising moving the printing of the raised marks to a different one of the plurality of raised image areas for each subsequently-printed substrate.

3. The method of claim 1, further comprising determining a number of substrates in a group of substrates by dividing a total number of substrates by a number of raised image areas identified on the surface of the substrate, the cycling of the printing of the raised marks comprising moving the printing of the raised marks to a different one of the plurality of raised image areas after printing the number of substrates in the group of substrates.

4. The method of claim 1, the plurality of raised image areas on the surface of the substrate being separate and distinct image areas in a non-overlapping relationship with one another.

5. The method of claim 1, the marking material comprising a radiation curable gel ink.

6. The method of claim 5, the radiation curable gel ink being a clear ultraviolet curable gel ink.

7. The method of claim 6, the clear ultraviolet curable gel ink comprising at least one monomer that becomes cross-linked in an exposure process to resist deinking.

8. The method of claim 6, the clear ultraviolet curable gel ink being mixed with at least one of a phosphorescing or fluorescing material.

9. The method of claim 8, the at least one of the phosphorescing or fluorescing material comprising at least one of a dye or particles mixed with the clear ultraviolet curable gel ink.

10. The method of claim 1, the substrates being currency, the method further comprising formatting the raised marks to identify a denomination of the currency.

11. The method of claim 10, the formatting of the raised marks employing a Braille lettering and numbering scheme to identify the denomination and the issuing authority of the currency.

12. The method of claim 1, the raised marks having heights above the surface of the substrate in a range of 100 to 500 μm.

13. A system for controlling printing raised marks on a plurality of substrates, comprising:

a raised mark positioning device that identifies a plurality of separate and distinct, non-overlapping raised image areas on a surface of a substrate;

a processor that is programmed to:

direct an image forming device to print raised marks in one of the plurality of raised image areas on each substrate, the image forming device being controlled by the processor to deposit a marking material on the substrate, and cycle the printing of the raised marks among the plurality of raised image areas for a plurality of substrates in order that an output stack of finished substrates has the raised marks being relatively evenly distributed among the plurality of raised image areas for the plurality of substrates.

14. The system of claim 13, the processor being further programmed to cycle the printing of the raised marks by directing moving of the printing of the raised marks to a different one of the plurality of raised image areas for each subsequently-printed substrate.

15. The system of claim 13, the processor being further programmed to:

determine a number of substrates in a group of substrates by dividing a total number of substrates by a number of raised image areas identified on the surface of the substrate, and cycle the printing of the raised marks by directing moving of the printing of the raised marks to a different one of the plurality of raised image areas after printing the number of substrates in the group of substrates.

16. The system of claim 13, the marking material comprising a clear ultraviolet curable gel ink.

17. The system of claim 16, the clear ultraviolet curable gel ink comprising at least one monomer that becomes cross-linked in an exposure process to resist deinking, the clear ultraviolet curable gel ink being mixed with at least one of a phosphorescing or fluorescing material.

18. The system of claim 13, further comprising a raised mark formatting device that formats the content of the raised marks to identify characteristics of at least one of the substrate or an image formed on the substrate in a manner that is tactilely discernible.

19. The system of claim 18, the substrates being currency, the raised mark formatting device formatting the raised marks to identify at least one of a denomination and an issuing authority of the currency.

20. A non-transitory computer-readable medium storing instructions which, when executed by a processor, cause the processor to execute the steps of a method comprising:

identifying a plurality of raised image areas on a surface of a substrate;

printing raised marks in one of the plurality of raised image areas on each substrate, the printing of the raised marks comprising depositing a marking material on the substrate by an image forming device;

cycling the printing of the raised marks among the plurality of raised image areas for a plurality of substrates; and outputting a stack of finished substrates, the raised marks being relatively evenly distributed among the plurality of raised image areas for the plurality of substrates.

* * * * *